United States Patent [19]

Pedone

[11] 4,271,771

[45] Jun. 9, 1981

[54] WORKPIECE TRIMMING DEVICE FOR SEWING MACHINES

[75] Inventor: Egidio Pedone, Corsico, Italy

[73] Assignee: Rockwell-Rimoldi, S.p.A., Milan, Italy

[21] Appl. No.: 175,629

[22] Filed: Aug. 6, 1980

[51] Int. Cl.[3] ..... D05B 37/04

[52] U.S. Cl. ..... 112/122

[58] Field of Search ..... 112/129, 130, 122, 128

[56] References Cited

U.S. PATENT DOCUMENTS

| | | | |
|---|---|---|---|
| 1,435,945 | 11/1922 | Scott | 112/122 |
| 1,509,148 | 9/1924 | Hughes, Jr. | 112/122 |
| 1,928,587 | 9/1933 | Card | 112/122 |
| 1,933,038 | 10/1933 | Zeier et al. | 112/122 |
| 2,915,996 | 12/1959 | Charest | 112/122 |

*Primary Examiner*—H. Hampton Hunter

[57] ABSTRACT

A workpiece trimming device for sewing machines having a fixed blade mounted in one side of the machine's presser foot and a movable blade operatively associated with the underside of the fixed blade reciprocally driven within a passage formed on the opposite side of the presser foot in alignment with the fixed blade. A first biasing force acting on the presser bar continually urges the presser foot in the direction of the needle plate and a second biasing force acting in the opposite direction of the first maintains contact between the fixed and movable blades. The first and second biasing forces acting in opposite directions provides an improved means for controlling the intended functions of the presser foot and cooperating trimming blades.

4 Claims, 3 Drawing Figures

WORKPIECE TRIMMING DEVICE FOR SEWING MACHINES

BACKGROUND OF THE INVENTION

The present invention pertains to an improved cutting device for trimming adjacent edges of pieces of fabric being joined by means of flat seam stitching with a covering stitch in a sewing machine. When two pieces of material are to be joined by seaming in a manner whereby their sewn edges are disposed in co-planar and contiguous relation, it is common practice to feed the two pieces into the machine so that the finished and joined edges are formed adjacent to the original edges of each piece which are severed from the latter immediately prior to the seaming operation. This is accomplished by positioning the pieces so that the major portion of both are disposed on the same horizontal plane and with the adjacent edges of each being turned at right angles to said horizontal plane and in abutting relationship with one another. These abutting edges are caused to enter a guide formed in the machine's presser foot and are severed from the two pieces just prior to the latter being subjected to the seaming operation of the flat-seam and covering stitch type.

To perform seaming operations of this type which are commonly referred to as cut-stitch operations, trimming devices are provided which include a fixed blade disposed horizontally in the base of the presser foot and which extends perpendicular to the direction of advance of a workpiece. Such trimming devices also include a movable blade carried by a movable support which locates it in operative association with the fixed blade and the movable support is operatively connected to any suitable actuating means forming a part of the machine itself. The movable support is also provided with a biasing means which serves to maintain contact between the fixed and movable blades. The presser foot is attached to the lower end of the fabric presser bar which is supported in the frame of the sewing machine and in a known manner is continuously biased by spring means associated with said presser bar in the direction of the usual needle plate which is mounted in the machine's worksurface that supports the workpieces during the sewing operation. A conventional transport means or feed dogs cooperate in a known manner with the underside of the presser foot to effect advance of the workpiece during the seaming operation. The biasing means operatively associated with the movable support is adapted to act on the movable blade so as to continually urge it into contact with the fixed blade even when the presser foot is being displaced in an upwardly direction away from the needle plate.

In the known type of trimming devices described above, the fixed blade is supported in the base portion of the presser foot so as to be in relatively close proximity with the needle plate and the movable blade is located above and in operative association with said fixed blade. The biasing means for the movable support serves to maintain the two blades in operative contact by pressing downwardly on the movable blade thus effecting its actuation in a positive manner. This downward force on the movable blade coupled with the biasing means acting on the presser bar subject the feed dogs, to what is considered, an excessive amount of downward force by the presser foot. As a result of this the feed dogs in order to perform their intended function must overcome the combined forces of both biasing means associated with the presser bar and movable blade.

It must be understood that both of these biasing means must be capable of producing selected and accurate amounts of force which differ one from the other in view of the function each is caused to perform. In particular, the biasing means for the presser bar should be such that the force it exerts while cooperating with the feed dogs will not have any damaging effects on the structure of the workpiece being advanced therebetween. Additionally, the biasing means for the movable support must be sufficient to maintain operative contact between the two blades without subjecting them to too great a biasing force which would result in excessive wear and a shortened life expectancy of said blades. These factors are considered serious in known trimming devices for it is quite difficult and time consuming to obtain the most desirable setting of each of the two biasing means so that the forces they provide will be the most advantageous for the particular characteristics of the material forming the workpiece.

Additionally, the biasing means for the movable supports in the known trimming devices are subjected to compression forces caused by the upward movement of the feed dogs which passes through the fabric to the presser foot and in a direction that opposes the spring force pressing on said fabric and being directed in an upwardly direction, said compression forces are transmitted to the biasing means acting on the movable blade. This condition occurs when contact between the two blades is such that their cutting edges are in spaced relation which defines their inactive or rest position and places undue stress on the movable blade. This condition also creates an unbalanced condition in the presser foot which can be attributed to the biasing means of the movable support that creates a greater degree of compression on the side of said presser foot at which said movable blade is operating.

As a result of the increased forces on one side of the presser foot, the fabric being advanced by the latter has a tendency to become misaligned or in other words, the fabric is urged to rotate out of alignment with the intended path it should follow during its advancement.

It is a general object of the present invention to eliminate the described disadvantages prevalent in known trimming devices.

A further object is that of lightening the loads on the elements which are in frictional contact and in contact with the fabric so as to substantially reduce wear between the blades and provide a means to maintain desired control of the forces acting on the presser foot during advancement of the fabric so that the latter accurately follows its intended and desired path toward the sewing zone.

SUMMARY OF THE INVENTION

According to the invention, these and other objects are acccomplished by an improved fabric trimming device in which the movable blade is disposed adjacent the base of the presser foot and in frictional contact with the underside of the fixed blade and includes a biasing means for maintaining said movable blade in contact with said fixed blade. Additionally, this biasing means is arranged to act on the movable blade in a direction opposite to that of the biasing means acting on the presser foot.

The feature of causing the biasing means associated with the movable support to act on the movable blade in a direction opposite to the biasing means acting on the presser foot provides a means whereby the desired amount of pressure between the two blades can be obtained and maintained which is best suited for the particular type of material forming the workpiece. Additionally, during the period when the feed dogs project above the needle plate there is a limited amount of release of pressure between the two blades for the fixed blade which is being raised with the presser foot permits the spring, forming the biasing means for the movable blade, to increase in length to the extent of slightly reducing the biasing force with which said movable blade engages said fixed blade.

The device according to the invention is effective in reducing frictional wear between the two blades to a minimum and to maintain the presser foot in a balanced state whereby its underside maintains full contact with the workpiece so that the latter advances along its intended path of travel without any deviations therefrom.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
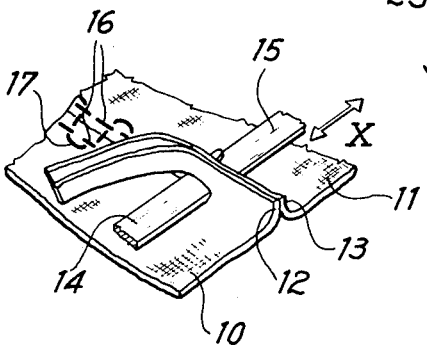
FIG. 1 is a perspective view of a portion of a workpiece showing the invention's two cutting blades in operative association with the edges thereof.

Referring now to the drawing, a portion of a workpiece is shown in FIG. 1 which is formed by two pieces of material 10 and 11 with their respective edges 12 and 13 being folded to extend in side by side relation in a plane substantially perpendicular to that containing the remainder of said pieces. The two edges 12 and 13 to be trimmed are cut by two operatively associated blade elements which define a stationary or fixed blade 14 and a movable blade 15 which is caused to move alternately to and fro in the directions depicted by the arrow X and is effective in severing the edges to be trimmed at a point in time when the fabric pieces are stationary between two successive steps for advancing it. Immediately following the cutting area, a so-called flat-seam is being formed which includes seaming stitches 16 and covering stitches 17. This type of seaming is well known to those conversant in the art and to describe it in further detail at this time is considered unnecessary.

Figure 2:
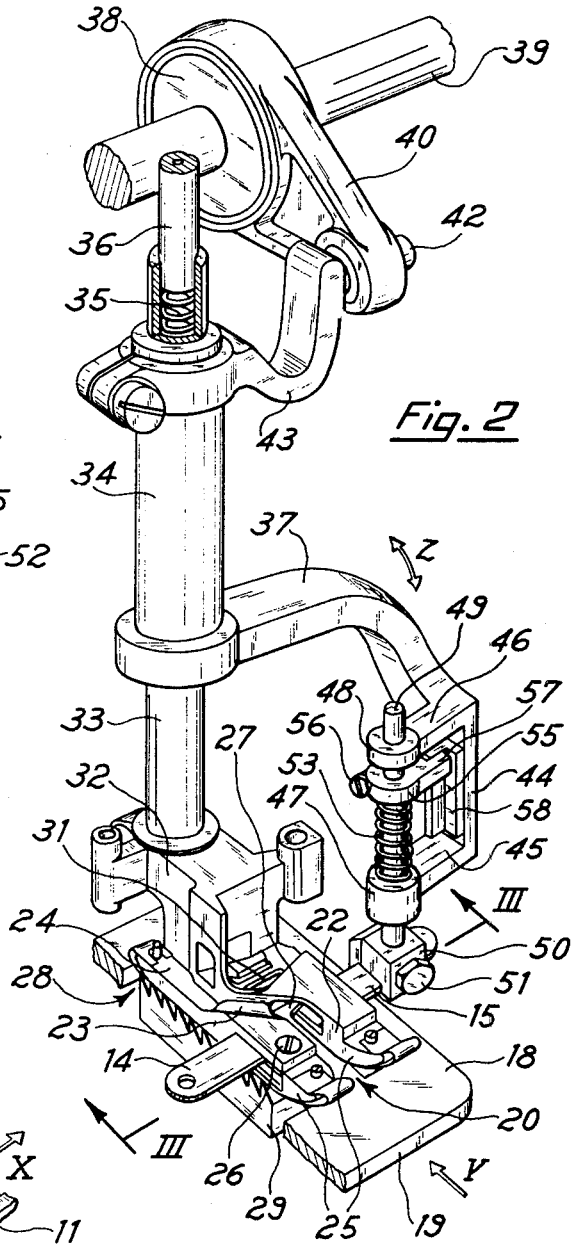
FIG. 2 is a perspective view of a portion of a sewing machine showing the trimming device according to the invention applied thereto.

To accomplish the above cutting operation, the fabric pieces are fed onto the worksurface of the machine which includes the usual needle plate 18 that forms a part of said machine's framework 19 and the edges to be trimmed are inserted in an opening or guide passage 20 formed between two spaced arms (FIG. 2) of the presser foot. These edges are guided by a wall 22 forming the sides of the guide passage to the location of the blade elements 14 and 15 after which the severed edge portions are removed laterally by means of a guide 23. In FIG. 2 the indicating arrow Y identifies the direction of advance of the workpiece. The presser foot is identified by numeral 24 and includes a base portion 25 one side of which is adapted to fixedly support the fixed blade 14 therein by means of a screw 26. This fixed blade also includes a longitudinally extending finger 27 formed on one end thereof which serves to guide and maintain contact with the movable blade 15 when the latter during its movement is at a distance furthest from the location of performing its cutting function. As shown in FIG. 2 the needle plate 18 includes the usual openings generally indicated by numeral 28 which provide the well known means for the feed dogs 29 of the fabric transport device to perform its intended function. The feed dogs, in a known manner, travel in a generally elliptical pathway by being caused to move upwardly in the direction of the presser foot, thence in the direction of arrow Y and then downwardly and back to their initial position for repeating the cycle.

During the advancing movement in the direction Y and in particular at the start of this movement, the feed dogs of the transport device applies stress, via the fabric, on the presser foot, and produces an upwardly directed force on the latter. Advance of the workpiece is accomplished by means of the conventional sawtooth configuration 30 which forms the upper surface of the feed dogs 29. As shown in FIG. 2, the presser foot also includes the usual openings 31 through which the machine's needle (not shown) is caused to travel during the sewing operation.

The presser foot 24 is supported in a conventional manner by a support 32 connected to a fabric presser bar 33 which is housed so as to be slidable in the vertical direction within a sleeve 34. The fabric presser bar 33 is biased in a downwardly direction by means of a fabric presser spring 35 and the biasing force of the latter can be adjusted by means of a regulating plunger 36. The fabric presser bar transmits a pre-selected amount of force on the presser foot 24, which passes through the fabric and to the teeth of the feed dogs. When the feed dogs are raised, they cause simultaneous raising of the presser foot that results in a slight compression of the fabric presser spring 35 which increases the biasing force being applied to the presser foot.

The movable blade 15 is carried by a support arm 37 connected to the sleeve 34 and is caused to oscillate in the directions depicted by the indicating arrow Z by means of an eccentric member 38 operatively connected therewith which is mounted on a rotatably driven shaft 39. The means which operatively connects the eccentric member 38 with the support arm 37 includes a connecting rod 40 (FIG. 2) having a pin 42 which interconnects it with one end of an arcuated arm 43 whose opposite end is fixed on the sleeve 34 so as to cause said sleeve and support arm to oscillate about the axis of the fabric presser bar 33. This driven shaft 39 and the eccentric member 38 are housed in the upper horizontal arm (not shown) of the sewing machine.

Figure 3:
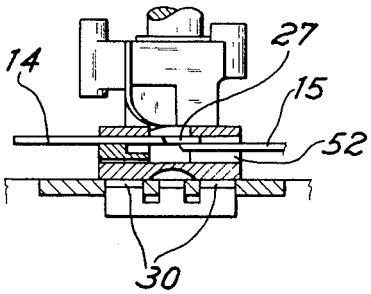
FIG. 3 is a sectional view as seen looking in the direction of the indicating arrows of line III—III in FIG. 2.

The support arm 37 has a U-shaped bracket 44 forming that end opposite the end attached to the sleeve 34 and the arms of this bracket are identified by numerals 45 and 46. These arms 45 and 46 have bushings 47 and 48 respectively attached thereto in vertically aligned relation and serve to support a rod 49 for sliding movement therein. The lower end of rod 49 has a support block 50 fixed thereon which supports the movable blade 15 by means of a locking screw 51. From the support block 50 the movable blade 15 extends in the direction of and into an opening or guide passage 52 (FIG. 3) provided in one side of the presser foot 24. The location of the movable blade 15 is such that it is disposed below the fixed blade 14 and the latters longitudinally extending finger 27, in other words the movable blade 15 is closer to the needle plate with respect to the fixed blade 14. The biasing force of the movable blade 15 against the fixed blade 14 and the finger 27 is provided by means of a helical spring 53 which presses at one end against the bushing 47, which is fixed to the arm 45 of the bracket 44, and at the other end against a stop element 55 which is fixed on the rod 49 in an adjustable manner by means of a screw 56. A finger 57 on the stop element 55 rests against a vertically extending guide 58 which is fixed to the bracket 44 intermediate its arms 45 and 46 and serves to prevent oscillation of the movable blade 15.

In operation of the biasing force provided by the helical spring 53 is directed toward the stop element 55 urging the latter and the rod 49 upwardly so that the movable blade 15 is also urged upwardly into frictional contact with the fixed blade 14 and its longitudinally extending finger 27. Additionally, it is possible to regulate the biasing force which the spring 53 produces so as to provide the most desirable operating pressure between the two blades 14 and 15 which is independent of the biasing force provided by the fabric presser spring 35. When the presser foot 24 is raised by the feed dogs 29, the fixed blade 14 moves upwardly therewith and such movement subjects the spring 35 to further compression. As a result of this, the movable blade 15 is also raised under the action of the spring 53 and the biasing force provided thereby is reduced, so that there is a reduction in the biasing force by the knife 15 on the finger 27, if the advancing operation occurs when the blade 15 is in the rest position shown in FIG. 2. By causing the helical spring 53 and the spring 35 to direct their forces in opposite directions provides the necessary means for substantially reducing frictional wear between the two blades 14 and 15 and maintains the presser foot 24 in a balanced state so that the workpieces will not become misaligned from their intended path of advancement.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A workpiece trimming device for sewing machines of the type including a needle plate mounted on the machine's worksurface and a presser bar for supporting a presser foot for cooperation with feeddogs operatively associated with the needleplate, said trimming device compising:

(a) a fixed blade (14) horizontally mounted within the presser foot to extend perpendicular to the direction of workpiece advancement;

(b) a presser spring (34) operatively associated with the presser bar for continually urging the latter and presser foot carried thereby in the direction of the needleplate;

(c) means defining a guide passage (52) formed in one side of the presser foot in alignment with said fixed blade (14);

(d) a movable blade (15) including:

(i) means for supporting it for reciprocating movement within said guide passage (52) and in operative contact with the underside of said fixed blade (14); and (e) biasing means mounted on said supporting means for continually urging said movable blade (15) into engagement with said fixed blade (14) and in a direction opposite to the direction of force provided by said presser spring (34) on the presser foot.

2. The structure according to claim 1 wherein said fixed blade (14) includes a longitudinally extending finger (27) formed on one end thereof for maintaining contact with said movable blade (15) when the latter is a position most remote from that of performing its intended fucntion.

3. The structure according to claim 1 wherein said supporting means defines a support arm (37) mounted for oscillating movement on the presser bar and a vertically extending rod (49) for supporting said movable blade assembled for limited rotational movement on one end of said support arm.

4. The structure according to claim 3 wherein said biasing means defines a helical spring (53) and a selectively positionable stop element (55) mounted on said rod (49) for urging the latter in an upwardly direction and the movable blade (15) carried thereby into contact with said fixed blade.

* * * * *